US006808019B1

(12) United States Patent
Mabry

(10) Patent No.: US 6,808,019 B1
(45) Date of Patent: Oct. 26, 2004

(54) SUCKER ROD GUIDE AND PARAFFIN SCRAPER FOR OIL WELLS

(76) Inventor: John F. Mabry, 307 E. 24th Ct., Owasso, OK (US) 74055

( * ) Notice: Subject to any disclaimer, the term of this patent is extended or adjusted under 35 U.S.C. 154(b) by 0 days.

(21) Appl. No.: 10/236,322

(22) Filed: Sep. 6, 2002

(51) Int. Cl.[7] ..... F21B 37/02
(52) U.S. Cl. ..... 166/176
(58) Field of Search ..... 166/170, 173, 166/176, 177

(56) References Cited

U.S. PATENT DOCUMENTS 2,175,770 A * 10/1939 Dodson
3,058,524 A 10/1962 Tripplehorn ..... 166/176
3,399,730 A * 9/1968 Pourchot
3,438,404 A 4/1969 Tripplehorn ..... 140/93
3,537,519 A 11/1970 Long ..... 166/175
4,589,483 A 5/1986 Sable ..... 166/176
4,995,459 A 2/1991 Mabry ..... 166/176

* cited by examiner

*Primary Examiner*—William Neuder
(74) *Attorney, Agent, or Firm*—Gable & Gotwals; Paul H. Johnson

(57) ABSTRACT

A guide for use on a sucker rod vertically reciprocated within the tubing of an oil well having an internal cylindrical surface in which the guide has an elongated tubular body portion concentrically surrounding the sucker rod with first and second guide portions integrally extending from the body portion, each guide portion having a semi-cylindrical guide surface of diameter slightly less than the tubing and of arc of about 180°, the second guide portion being rotationally diametrically opposed to the first guide portion whereby the opposed guide surfaces together provide about 360° of guide surface adjacent the tubing internal cylindrical surface and wherein the first and second guide portions are displaced with respect to each other providing a pair of diametrically opposed fluid flow passageways.

20 Claims, 11 Drawing Sheets

SUCKER ROD GUIDE AND PARAFFIN SCRAPER FOR OIL WELLS

REFERENCE TO MICROFICHE APPENDIX

This application is not referenced in any microfiche appendix.

FIELD OF THE INVENTION

This invention relates to a guide for use on a sucker rod for purposes of stabilizing a sucker rod as it is reciprocated in tubing and/or for scraping paraffin from the tubing wall.

BACKGROUND OF THE INVENTION

A primary source of energy used in the world today is derived from liquid crude oil that is extracted from subterranean formations. When a well is drilled into an oil-bearing stratum, the pressure within the stratum may be sufficient to force the crude oil to the earth's surface and in such case, no pumping action is required. However, in many areas of the world, the subterranean pressure is insufficient to force crude oil to the earth's surface and therefore it must be pumped from the oil-bearing formation to the earth's surface to be processed and refined. Some oil-bearing formations have sufficient formation pressure to initially force crude oil to the earth's surface when a well is first drilled but after time the formation pressure diminishes to the point that the crude oil can be extracted only by pumping.

Crude oil can be pumped from a subterranean formation to the earth's surface in a number of ways including electrically driven centrifugal down hole pumps, hydraulically actuated down hole pumps and hydraulically actuated jet pumps. However, a most common means of pumping oil from a subterranean formation to the earth's surface is by means of sucker rod actuated pumps.

When the typical oil well is drilled, a casing is installed to prevent cave-in, the casing extending from the earth's surface to the bottom of the well. To convey fluid from the formation to the surface, a string of tubing is typically run inside the casing. When a sucker rod pump is employed, it is anchored within a lower end of the tubing and the pump is reciprocated by means of a string of sucker rods extending from the earth's surface. Sucker rods are typically formed of steel and are installed by means of couplings that are attached between threaded ends of the rods. A typical sucker rod may, for instance, be of about 25 feet in length with a coupling between each length of rod. The sucker rods reciprocate within tubing which typically may be 2–4 inches in internal diameter. Pumped oil wells vary in depth from a few hundred feet to several thousand feet. If an oil well is not perfectly vertical (and very few wells are perfectly vertical) the sucker rods tend to slide against the interior surface of the tubing. Couplings are of larger diameter than the sucker rods. Vertical reciprocation of a sucker rod couplings against the interior surface of tubing is detrimental both to the coupling and to the tubing itself. Over a long period, a coupling can wear to the point it becomes defective causing the sucker rods to separate or a hole can be worn in the tubing causing crude oil production to flow out the hole of the tubing instead of to the earth's surface. Further, in deep wells there may be a tendency for sucker rods to whip against the interior walls of the tubing even if the tubing is substantially vertical. For all of these reasons in some wells it is important to provide stabilizers on the exterior of sucker rods to prevent excess wear of sucker rod couplings and the interior of the tubing.

Another problem encountered in pumping oil wells is paraffin. Most crude oil contains some paraffin, however, in some areas of the world the amount of paraffin in crude oil is significant. The temperature of producing formations is normally sufficiently high in that paraffin remains dissolved in the crude oil—that is, the paraffin remains liquid and can be pumped with the crude oil without any problem. However, as crude oil rises from a producing zone towards the earth's surface, the temperature gradually decreases. If the crude oil has significant paraffin, the temperature of the crude oil may reduce to the point that paraffin starts to congeal—that is, to be transformed from a liquid state to a solid state. As paraffin solidifies, it can adhere to the interior of tubing and ultimately become so thick on the tubing wall as to impair fluid flow to the earth's surface. To combat this it has been a known practice in the petroleum industry for many years to install paraffin scrapers on sucker rods for scraping at intervals equal to or slightly less than the stroke of the pump jack to keep the walls of the tubing from closing in to the point that fluid flow is restricted.

The invention herein is intended to attack not only the problems of sucker rod wear and stabilization but also paraffin removal.

The use of sucker rod guides and/or paraffin scrapers is very well known in the petroleum industry. For background information about the construction and operation of sucker rod guides and paraffin scrapers reference may be had to U.S. Pat. No. 4,995,459 issued to John F. Mabry on Feb. 26, 1991.

For additional information about sucker rod guides and/or paraffin scrapers see the following issued U.S. Patents:

| U.S. Pat. No. | Inventor(s) | Title |
|---|---|---|
| 3,058,524 | Tripplehorn | Migratory Paraffin Scraper |
| 3,438,404 | Tripplehorn | Method of Mounting Well Equipment |
| 3,537,519 | Long | Paraffin Scraper |
| 4,589,483 | Sable | Rod Centralizer |
| 4,995,459 | Mabry | Rod Guide/Paraffin Scraper |

BRIEF SUMMARY OF THE INVENTION

The invention herein is a sucker rod guide for use on a sucker rod that is vertically reciprocated within oil well tubing. The term "sucker rod guide" as used herein, means a device to keep sucker rods centered within oil well tubing and that simultaneously act to scrape or dislodge paraffin from the tubing interior wall. Thus "sucker rod guide" is inclusive of a paraffin scraper. The sucker rod guide of this invention is formed of tough, non-metallic preferably plastic material of a type that withstands elevated temperatures, and severe frictional wear, such as polyphenylene sulphide or nylon.

The sucker rod guide is formed of an elongated tubular body portion that concentrically surrounds the sucker rod. A first and second guide portion integrally extend from the body portion. Each guide portion has a semi-cylindrical guide surface of diameter slightly less than "D". Each guide portion has one portion with an arc of about 180°. The second guide portion is rotationally diametrically opposed to the first guide portion so that the opposed guide surfaces together provide about 360° of guide surface adjacent the tubing internal cylindrical surface so that thereby as the sucker rod to which the guide is affixed is reciprocated, the guide surfaces not only support the sucker rod centrally within the tubing but scrape loose accumulated paraffin from the entire cylindrical tubing wall.

The opposed guide surfaces are elevationally displaced with respect to each other to provide a pair of diametrically opposed fluid flow passageways which freely permit the flow of fluid past the sucker rod guide.

In a preferred embodiment, the guide surface on each of the guide portions is substantially in a teardrop form—that is, having a semi-cylindrical surface with an arc at one end that is about 180° with the arc of the guide surface tapering to a few degrees at an opposite end. The teardrop shaped guide surfaces are reversed with respect to each other providing non-linear fluid flow passageways therebetween. In another embodiment, the guide surface of each of the guide portions is substantially of a diamond shape in configuration with pointed upper and lower ends. In still another embodiment each of the guide portions has a guide surface t hat i s semi-cylindrical with generally planar surfaces at the upper and lower ends, the planar surfaces being generally taken in planes that are at an acute angle relative to the longitudinal axis of the sucker rod to which the guide s are affixed. In all cases, irrespective of the configuration of the guide portions they are rotationally directly opposed and oppositely elevationally oriented with respect to each other to provide flow channels therebetween for the passage of fluid.

The sucker rod guide of this invention can be employed in two basic formats. In the first way they are molded directly onto a sucker rod at spaced intervals, the distance between the intervals being slightly less than the length of stroke of the pumping unit for which the sucker rods are to be employed. Molding sucker rod guides directly onto sucker rods is normally done in a factory setting.

The second basic method of using the sucker rod guide of this invention involves producing molded halves, two of which snap together to make a complete sucker rod guide. In the preferred arrangement the halves of the molded sucker rod guide are identical requiring only a single mold design for producing halves that can be joined together by a sliding slant locking action. The sucker rod guide in the form of molded halves can be installed at a location in the oil field.

The molded halves each provide two pairs of integral tangs and two pairs of tang slots—that is, each side of each half of a molded sucker rod guide has a protruding tongue like tang portion and adjacent to a tang receiving recess. The tangs and recesses are shaped to provide interlocking relationships so that when one-half of a sucker rod guide is slipped into position adjacent a mating half each side of the sucker rod guide is locked to an opposing half of the sucker rod guide by the interlock relationship of tangs and tang slots. An important feature of this invention is that the tangs and tang slots by which two halves are locked into position around a sucker rod are positioned centrally of the guide opposed ends.

Each molded half of a sucker rod guide has interfitting inclined arcs that, as the halves are slid into a mating relationship with each other, provide a tightening effect to cinch the two halves together around a sucker rod as the tangs snap into the tang slots in final locked positions.

A more complete understanding of the invention will be obtained from the following description of the preferred embodiments, taken in conjunction with the attached drawings.

BRIEF DESCRIPTION OF THE DRAWINGS

FIG. 12 is an end view of the sucker rod guide half that is opposite to the end view of FIG. 6.

FIG. 15 is an elevational view showing a portion of a length of a sucker rod in dotted outline and showing two halves of a field installed type sucker rod guide positioned on the sucker rod in preparation for snapping the two halves together to lock them onto the sucker rod.

FIG. 16 shows the two halves of the sucker rod guide in the process of being interlocked with each other.

FIG. 17 shows the two halves of the sucker rod guide in locked position as secured on the surface of the sucker rod.

FIG. 22 shows a mold-on type guide, but without a sucker rod upon which it would typically be molded.

DETAILED DESCRIPTION OF THE PREFERRED EMBODIMENTS

For explaining the present invention in detail it is to be understood that the invention is not limited in its application to the details of the construction and arrangement of the parts illustrated in the accompanying drawings. The invention is capable of other embodiments and of being practiced or carried out in a variety of ways. It is to be understood that the phraseology and terminology employed herein are for the purpose of description and not of limitation.

Figure 1:
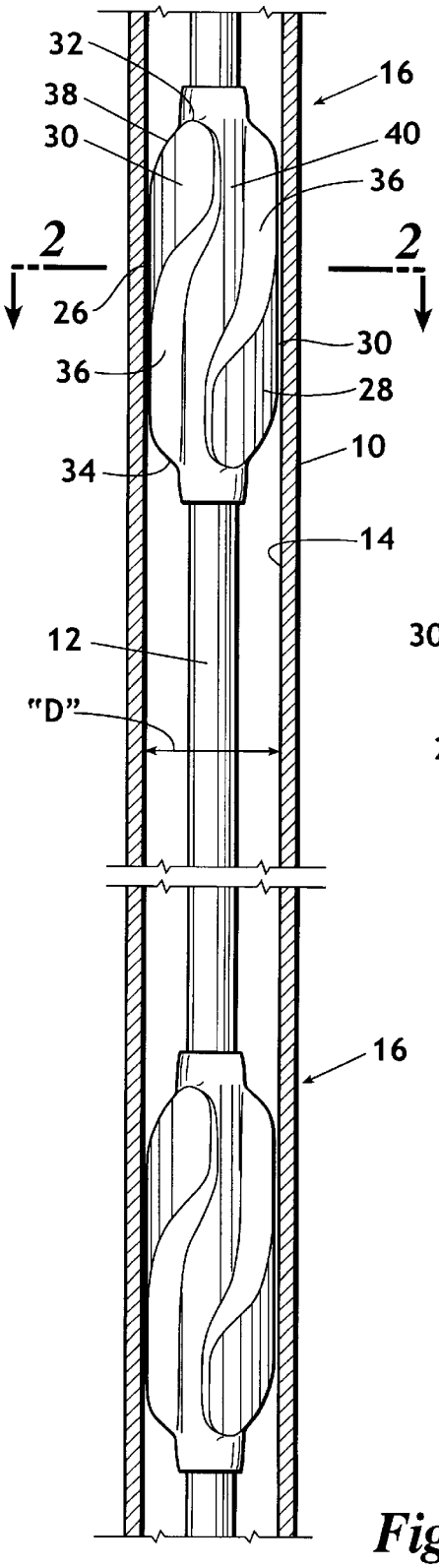
FIG. 1 is an elevational cross-sectional view of a short portion of a string of tubing, shown broken away, and shows within the tubing a short portion of a length of sucker rods having two sucker rod guides that are the subject of this disclosure. The sucker rod guides shown in FIG. 1 are the type that are molded directly onto the sucker rods and provide for centralizing the sucker rod within the tubing to thereby prevent wear of the sucker rod against the tubing internal wall. Further, the sucker rod guides scrape paraffin from the tubing wall to thereby prevent excessive paraffin accumulation.

Referring first to FIG. 1, the environment in which the sucker rod guide of this invention is illustrated. The term "sucker rod guide" is used herein to mean a device that is secured to a sucker rod to guide the sucker rod as it is reciprocated within tubing in an oil well. In addition to merely guiding the rod, the sucker rod guide serves to stabilize the rod to prevent it from whipping and lashing due to the reciprocal motion imparted to the rod, as well as to prevent wear of the sucker rod and sucker rod couplings against the interior cylindrical wall of the tubing. The third use of the sucker rod guide is to scrape or dislodge paraffin or other accumulation from the interior cylindrical wall of tubing so that fluid pumped from a subterranean formation can be moved unobstructively up the tubing to the earth's surface. Therefore, FIG. 1 shows a length of tubing 10, usually lengths of steel pipe that are coupled or strung together to extend from the earth's surface into an oil producing subterranean formation. Tubing 10 may be from several hundred to several thousand feet in length and is normally contained within a string of casing (not shown). The integrity of tubing 10 is important since if a leak occurs in the tubing, crude oil produced by pumping action would flow through the leak and not reach the earth's surface. Therefore, it is important to guard the interior of tubing 10 against wear.

The most common means for pumping crude oil from a subterranean formation to the earth's surface is by the means of reciprocated sucker rods. In FIG. 1, a portion of a length of sucker rod 12 is shown. Tubing 10 has a cylindrical internal surface 14 of an internal diameter "D." The tubing 10 is typically of internal diameter of two to four inches and a sucker rod 12 is normally solid steel or steel alloy rod that is typically from one-half to one inch in diameter. Thus, the diameter D of the interior of tubing 10 is substantially greater than the exterior diameter of sucker rod 12. Sucker rods are coupled end to end by means of sucker rod couplings (not shown) that have external diameters significantly less than "D."

Shown supported to the exterior surface of sucker rod 12 are two identical sucker rod guides each generally indicated by the numeral 16. The sucker rod guides 16 shown in FIG. 1 are of a type that are of non-metallic composition, preferably plastic and preferably of a form of plastic that withstands elevated temperatures as is encountered in oil wells and that resist severe frictional wear. While the sucker rod guides 16 may be made of a variety of different plastic materials, polyphenylene sulfide or nylon are excellent choices since these two types of plastic materials have low frictional co-efficients, resistance against deterioration from oil well heat and excellent wear characteristics. The length of a sucker rod guide 16 may vary but typically will be from about six to twelve inches, depending somewhat upon the size of tubing 10 for which they are designed.

Figure 2:
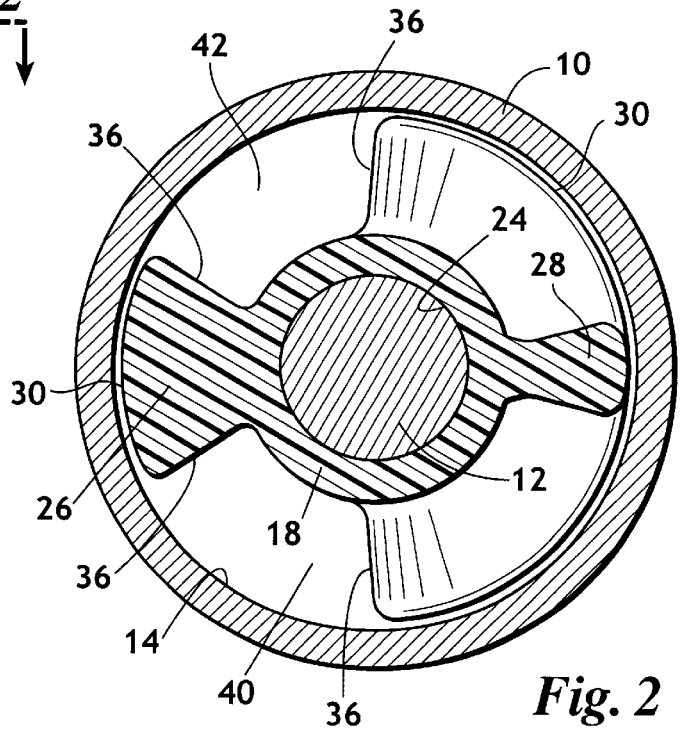
FIG. 2 is a cross-sectional view taken along the line 2—2 of FIG. 1 showing a sucker rod guide of this invention as secured to the exterior surface of the sucker rod as positioned within the tubing. Throughout this description the term "sucker rod guide" is used to mean an apparatus for guiding or centralizing a sucker rod within tubing and simultaneously for scraping or dislodging paraffin that may accumulate on the tubing cylindrical wall.
Figure 12:
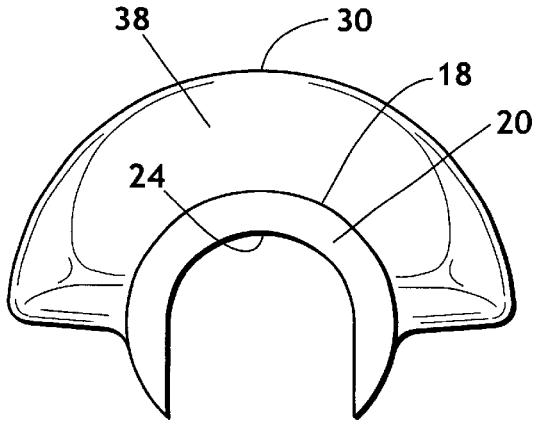
FIG. 12 is an end view of the one-half of a sucker rod guide as taken along the line 12—12 of FIG. 5.
Figure 3:
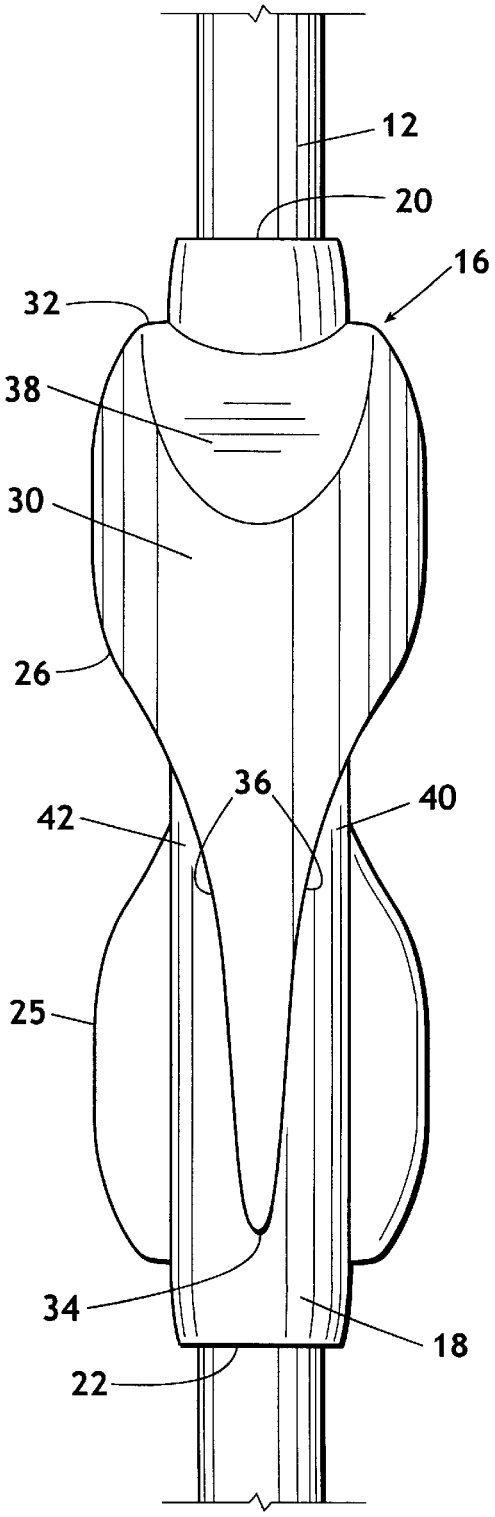
FIG. 3 is an elevational view of a sucker rod guide of this invention of the type that is molded onto the exterior surface of a sucker rod.
Figure 4:
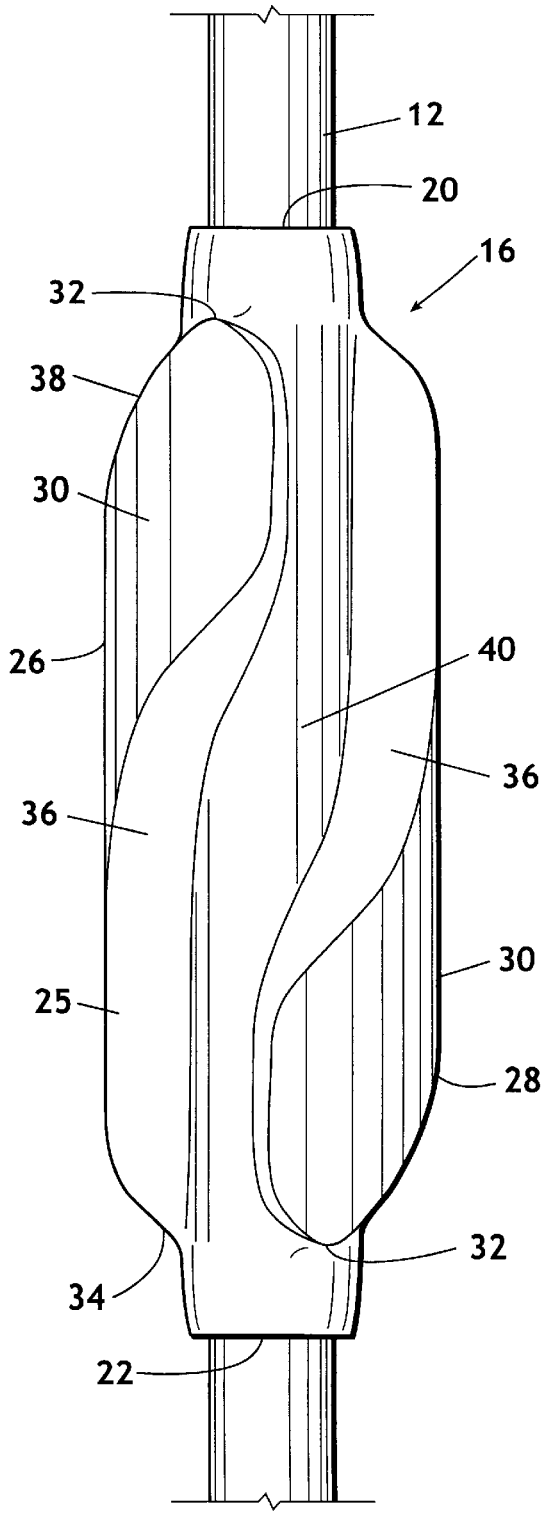
FIG. 4 is an elevational view as in FIG. 3 with the sucker rod guide rotated 90° about the sucker rod axis.
Figure 7:
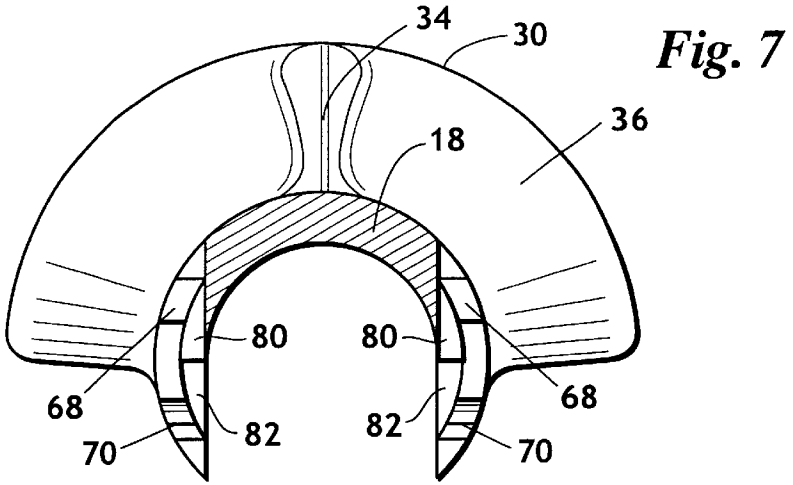
FIGS. 7, 8, 9, 10 and 11 are all cross-sectional views taken along the corresponding lines 7—7; 8—8; 9—9; 10—10; and 11—11 of FIG. 5 and all show various details of construction of one-half of a snap-on type of sucker rod guide.
Figure 6:
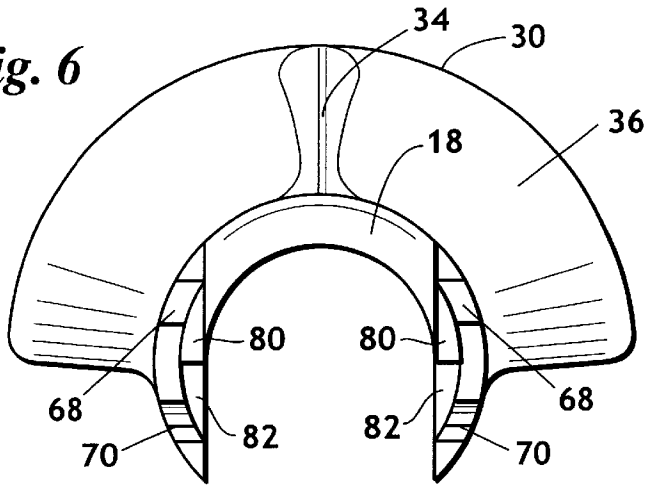
FIG. 6 is an end view of the snap-on type half of a sucker rod guide as taken along line 6—6 of FIG. 5.

FIGS. 2–4 show details of the embodiment of the sucker rod guide 16 as shown in FIG. 1. Each of the sucker rod guides includes a tubular body portion 18 having an upper end 20 and a lower end 22, and as seen in FIG. 2, a longitudinal cylindrical passageway 24 therethrough that surrounds sucker rod 12. In the embodiment of the invention of FIGS. 2–4, the sucker rod guide 16 is molded directly onto sucker rod 12, so therefore, the passageway 24 is not separately formed but is defined by the encapsulated sucker rod. Integrally formed with and onto the external cylindrical surface of tubular body portion 18 is a first guide portion 26 and a second guide portion 28. In a preferred arrangement of the invention, guide portions 26 and 28 are of essentially the same configuration except that guide portion 28 is rotated one hundred eighty degrees (180°) from first guide portion 26—that is, it is on the opposite side from first guide portion 26 and in addition, second guide portion 28 is elevationally reversed.

In the embodiment of FIGS. 1 through 4 the configuration of guide portions 26 and 28 is of generally teardrop shape with the teardrop configuration as seen in FIG. 3 being inverted so that the bulk of the guide portion 26 is adjacent the top end 20 of the tubular body portion 18. Whereas for guide portion 28, the bulk of it is near the bottom end 22 of tubular body 18.

Guide portion 26 has a semi-cylindrical guide surface 30 that is of a diameter slightly less than "D" —that is, slightly less than the diameter of the internal cylindrical surface 14 of tubing 10. Guide surface 30 is dimensioned and configured to closely fit the internal cylindrical surface 14 of tubing 10, but to be of slightly smaller diameter so that the tubular guide 16 can be freely reciprocated within the tubing as it moves with sucker rod 12 without imposing any restriction on the sucker rod movement. However, the guide surface 30 must be in close proximity to tubing internal cylindrical surface 14 so as to scrape away or dislodge paraffin or other encrustation to thereby keep the interior of the tubing free of blockage.

First guide portion 26 has an upper end 32 and a lower end 34. Upper end 32 is near a portion of the semi-cylindrical guide surface 30 that encompasses about one hundred eighty degrees (180°) of arc, whereas the second end 34 has a continuation of the cylindrical surface 30—that is, arc of only a few degrees so that essentially the cylindrical guide surface 30 is reduced in arc width to substantially a point at the lower end 34. Extending from the full one hundred eighty degree (180°) arc width portion of guide surface 30 to the lower end 34 are opposed side walls 36 of smooth aerodynamic shape.

A further characteristic of the shape of guide surface 30 is a relatively curved surface 38 adjacent the guide surface upper end 32.

The shape of second guide portion 28 is preferably the same as that of first guide portion 26, except that the guide surface 30A is elevationally inverted so that the widest or greatest arc portion of guide surface 30A is adjacent the lower end 22 of tubular body portion 18.

The orientation of first and second guide portions 26 and 28 to each other is important—that is, the guide portions are elevationally reversed and offset to opposite sides of each other on cylindrical body 18. This orientation provides two fluid passageways 40 and 42. These passageways provide for unobstructed streamlined, substantially laminar fluid flow past the sucker rod guides as fluid moves upwardly in its progression from a subterranean formation to the earth's surface.

Figure 22:
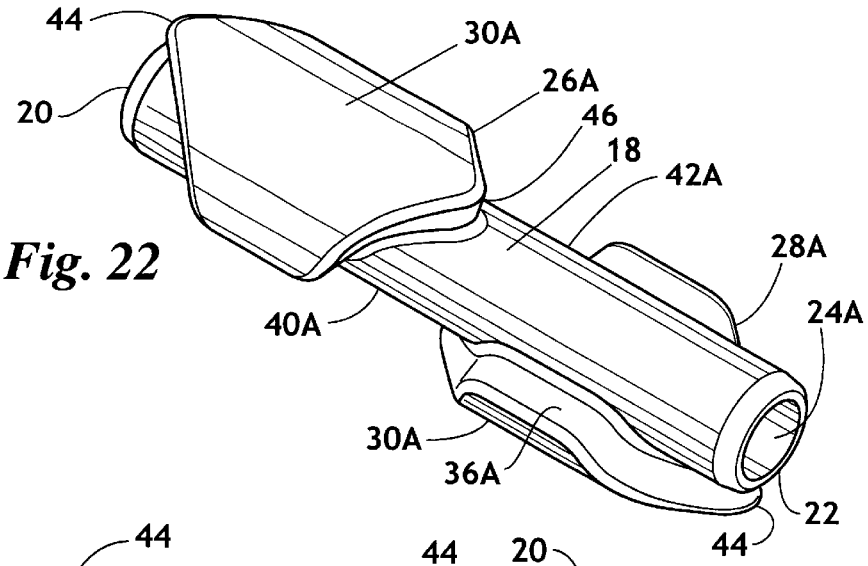
FIG. 22 is an isometric view of an alternate embodiment of the sucker rod guide of this invention.
Figure 23:
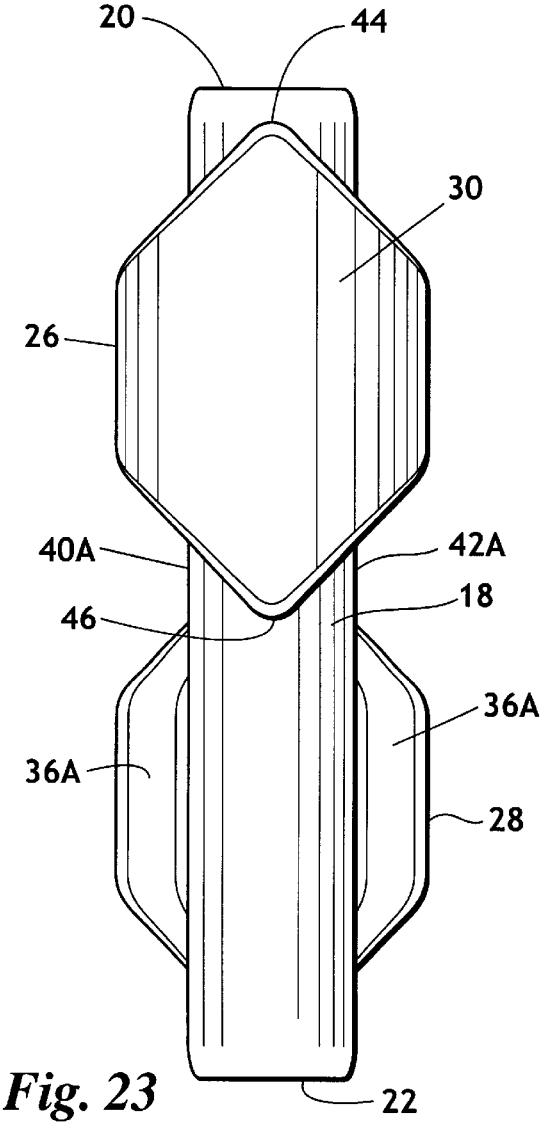
FIG. 23 is an elevational side view of a mold-on type sucker rod guide of FIG. 22 in which the integral guide portions of the guide are of substantially diamond-shaped.
Figure 24:
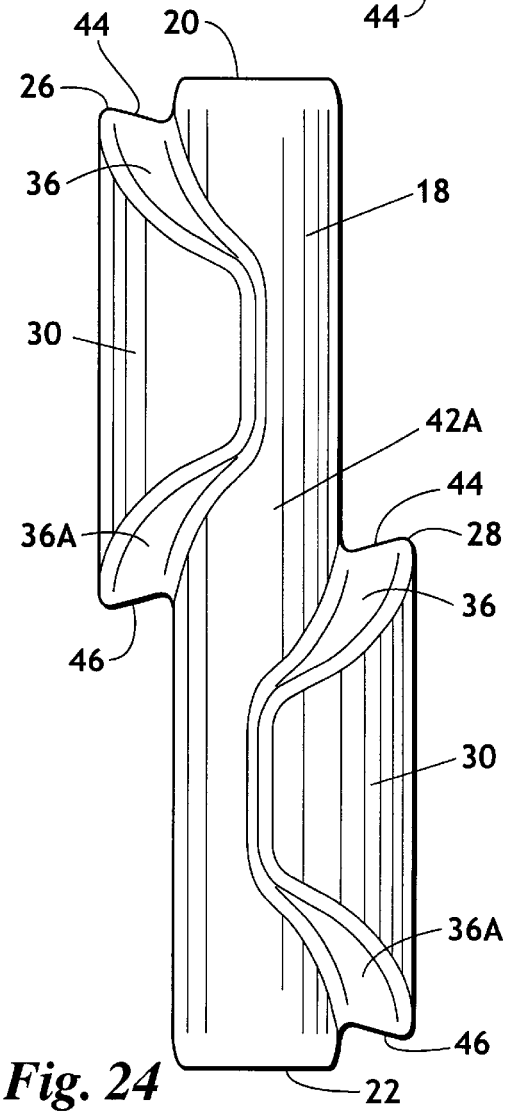
FIG. 24 is an elevational side view of the mold-on type sucker rod guide as shown in FIGS. 22 and 23, but with the guide rotated ninety degrees (90°) with respect to FIG. 23.

The invention herein is adaptable for use in two basic embodiments. The first is the mold-on embodiment as illustrated in FIGS. 1 through 4 as has been discussed. The second is in a premolded snap-on embodiment which is illustrated in FIGS. 5 through 21. Before discussing the snap-on embodiment, reference will now be had to FIGS. 22 through 30 which illustrate alternate embodiments of the mold-on design of this invention. In each embodiment, the sucker rod guide is formed starting with a tubular body 18, as has been described. In FIGS. 22 through 30, the tubular body 18 is illustrated with the passageway 24 therethrough, it being understood that this passageway represents the space that is occupied by a sucker rod as the guide is molded onto a sucker rod. In the embodiment of FIGS. 22 through 24, the shape of the guide portions and the guide surfaces are different than those in FIGS. 1 through 4, however, the function is the same. In FIGS. 23 through 24, the first guide portion 26A and second guide portion 28A are each of a basic diamond shaped configuration and each provides a semi-cylindrical guide surface 30A. Guide surfaces 30A are cylindrical throughout their length and the guide portions of the embodiment at FIGS. 22 through 24 include a pointed upper end 44 and pointed lower end 46. The guide portions 26A and 28A are, as previously stated, rotationally offset from each other and are, in addition, elevationally off-set. By these rotational and elevational off-sets, fluid passageways 40A and 42A are provided. The guide portions 26 and 28 have side walls 36A as described with reference to the first embodiment that form passageways 40A and 42A.

The embodiment of FIGS. 22 through 24 functions the same as FIGS. 1 through 4; the only difference being in the shape of the guide portions and correspondingly the guide surfaces, but in each instance, the guide surfaces are always semi-cylindrical and of diameter slightly less than D and in both cases, the guide portions each have a semi-cylindrical guide surface that covers an arc of about 180°.

In all cases, there are two guide portions and two guide surfaces rotationally and elevationally offset with respect to each other providing a pair of flow passageways and in an arrangement wherein the entire cylindrical interior surface of tubing is swept clean as the sucker rod having the guides thereon is reciprocated.

Figure 25:
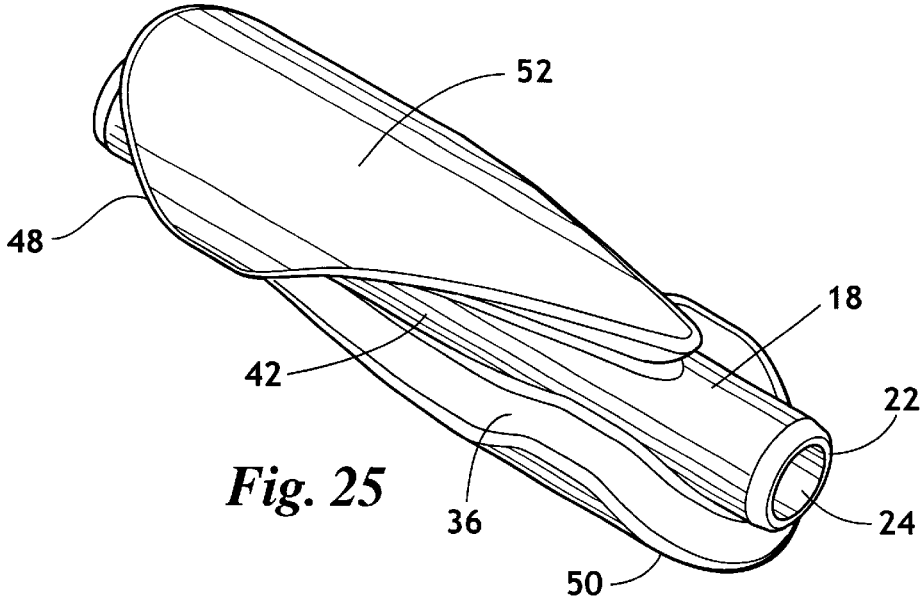
FIG. 25 is an isometric view of another embodiment of the sucker rod guide shown in the mold-on embodiment, but wherein the sucker rod on which it is molded is not shown.
Figure 26:
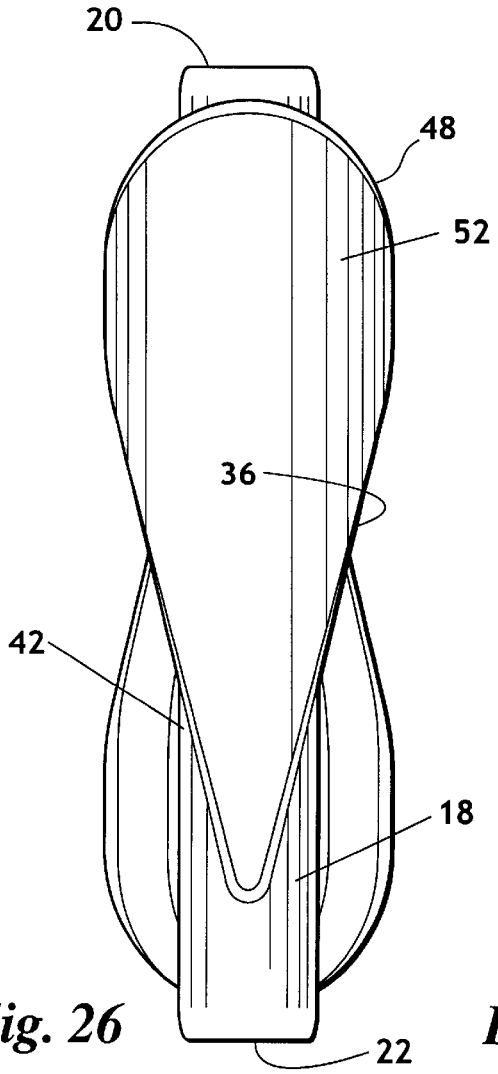
FIG. 26 is an elevational side view of the embodiment of the sucker rod guide of FIG. 25.
Figure 27:
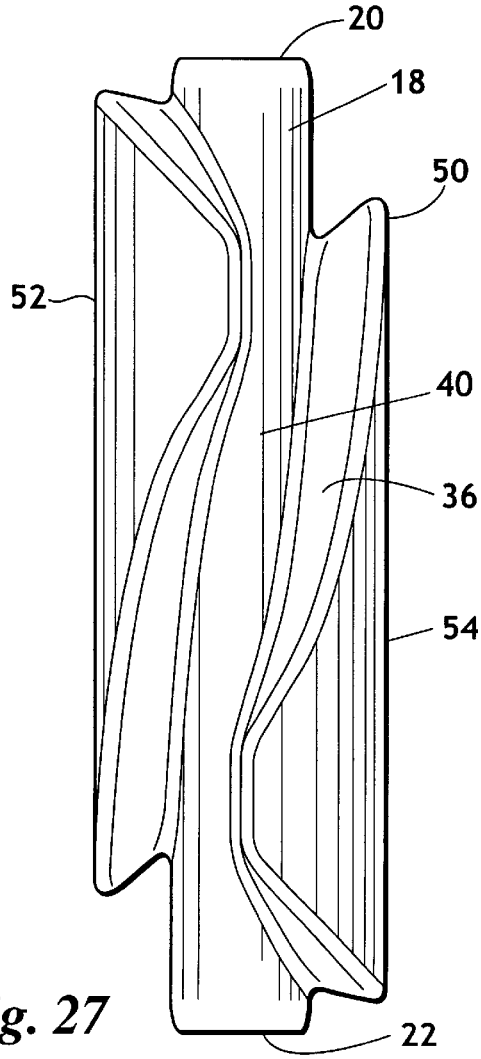
FIG. 27 is an elevational side view in which the sucker rod guide is rotated ninety degrees (90°) with respect to FIG. 23.

FIGS. 25 through 27 show an alternate embodiment of the sucker rod guide as shown in FIGS. 2 through 4. This embodiment includes a tubular body 18 and extending from the external cylindrical surface of the tubular body, a first integral increased thickness guide portion 48 and a second increased thickness guide portion 50. Guide portions 48 and 50 are identical and are located opposite each other—that is, radially 180° around the surface of tubular body 18. In addition, second guide portion 50 is elevationally inverted compared to first guide portion 48. First guide portion 48 has a guide surface 52 that is semi-cylindrical throughout its full length with the guide surface having, at its widest point, an arc of about 180°. In like manner, second guide portion 50 has a guide surface 54 that is cylindrical throughout its length with the widest part having an arc of about 180°. The guide surfaces 52 and 54 are tear shaped in general configuration with surface 52 being in an inverted tear shape and with surface 54 being in the normal configuration of a teardrop.

Comparing FIG. 26 with FIG. 3 illustrates the similarity in the designs and shows how the designs differ in shape in the contour of the side walls but they are otherwise similar in that they provide flow passageways 40 and 42 between the guide portions.

The embodiments of FIGS. 25 through 27 have the same features as have been described with reference to FIGS. 2 through 4 in that the mold-on sucker rod guides having this design provides for a guide surface that is essentially effective in wiping the full cylindrical interior of tubing as the sucker rod having the guide formed thereon is reciprocated.

Figure 28:
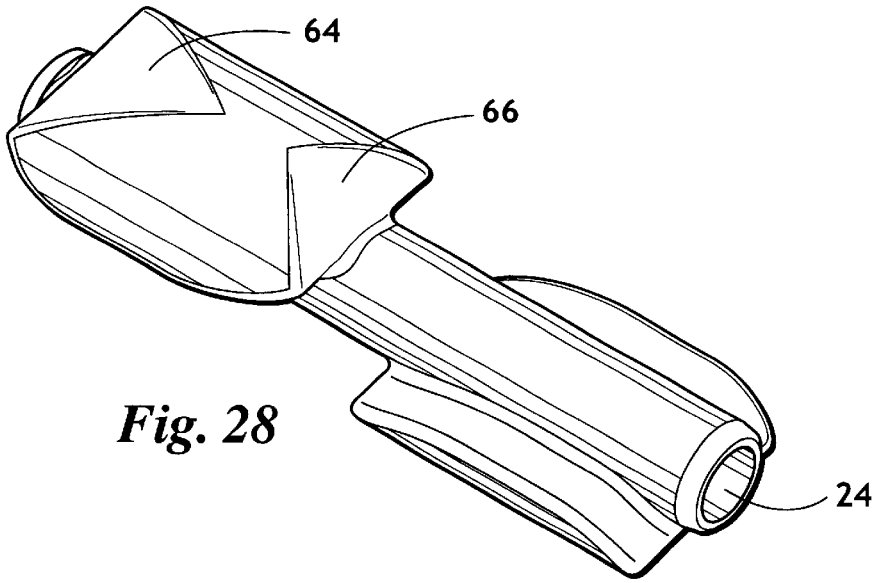
FIG. 28 is an isometric view of a fourth embodiment of the sucker rod guide of the mold-on type shown isometrically and without a sucker rod on which it is normally molded.
Figure 29:
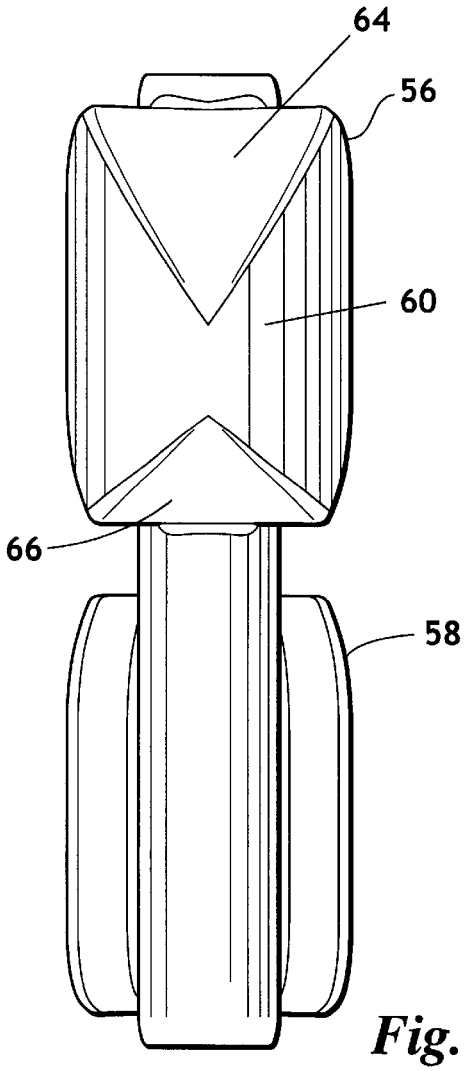
FIG. 29 is an elevational view of the embodiment of the mold-on type sucker rod guide as seen in FIG. 28.
Figure 30:
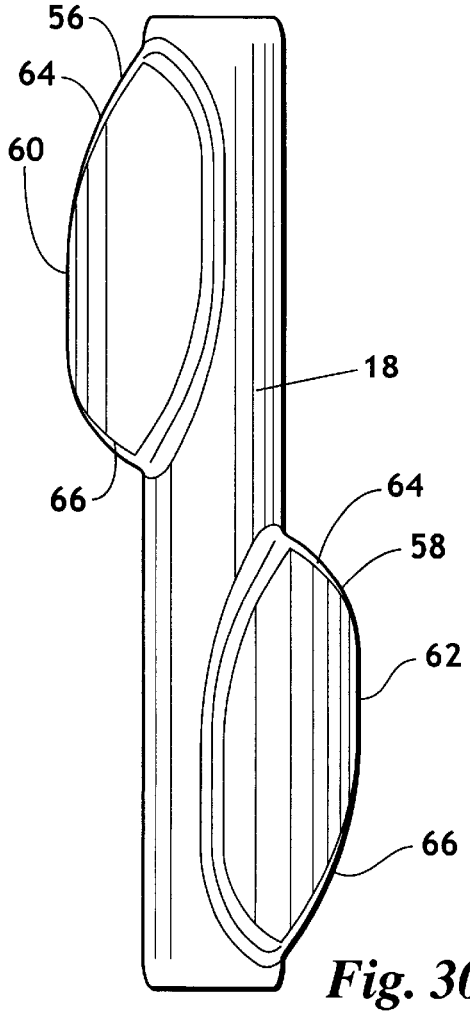
FIG. 30 is an elevational side view with the sucker rod guide rotated ninety degrees (90°) with respect to the view as seen in FIG. 29.

FIGS. 28 through 30 show still another alternate embodiment and one that is very similar to the embodiment of FIGS. 22 through 24. In FIGS. 28 through 30 a first guide portion 56 and a second guide portion 58 integrally extend from tubular body 18 and the guide portions have guide surfaces 60 and 62 respectively. The guide surfaces 60 and 62 are semi-cylindrical and each having a maximum arc of about 180°. The guide portions 56 and 58 are rotationally spaced on opposite sides of tubular body 18 and are elevationally separated to provide flow passageway therebetween.

Guide surfaces 60 and 62 are provided with relatively planar portions 64 and 66 to streamline movement of the sucker rod guides through fluid as the sucker rods to which the guides are attached reciprocate within a fluid column within a well tubing.

The embodiments of FIGS. 28 through 30 have the same features as discussed with respect to the previous embodiments—that is, the guide surfaces 60 and 62 are configured to closely conform to the interior cylindrical surface of tubing and to dislodge paraffin or other encrustation from the tubing surface through its full cylindrical interior area as the guides are reciprocated.

The embodiments of the sucker rod guide described to this point are all monolithic structures—that is, of a single entity molded in place onto the surface of a sucker rod. The other basic embodiment of the invention is illustrated in FIGS. 5 through 21 in which the sucker rod guide is of the slip-on type that can be applied to a sucker rod in a field location—the "slip-on" or "snap-on" embodiment of FIGS. 5 through 21 is formed of two identical halves that are molded in a factory and the halves can be joined together to form a sucker rod guide as will now be described.

Figure 5:
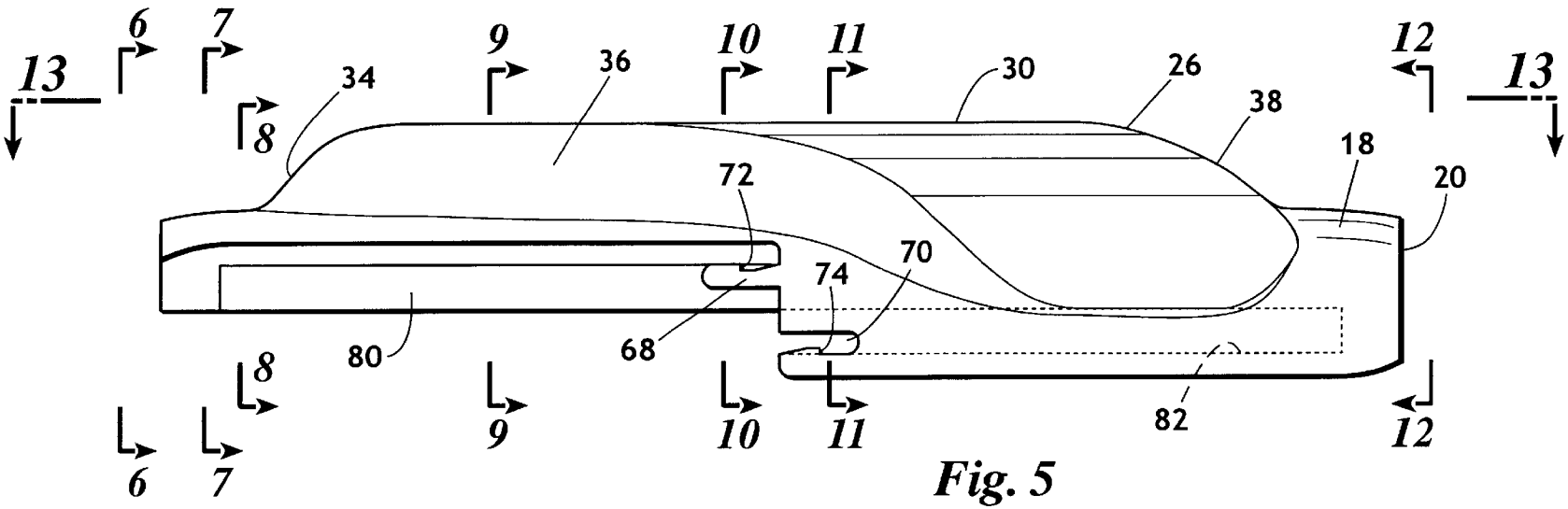
FIG. 5 is a side view of one-half of a snap-on type sucker rod guide of this invention.
Figure 9:
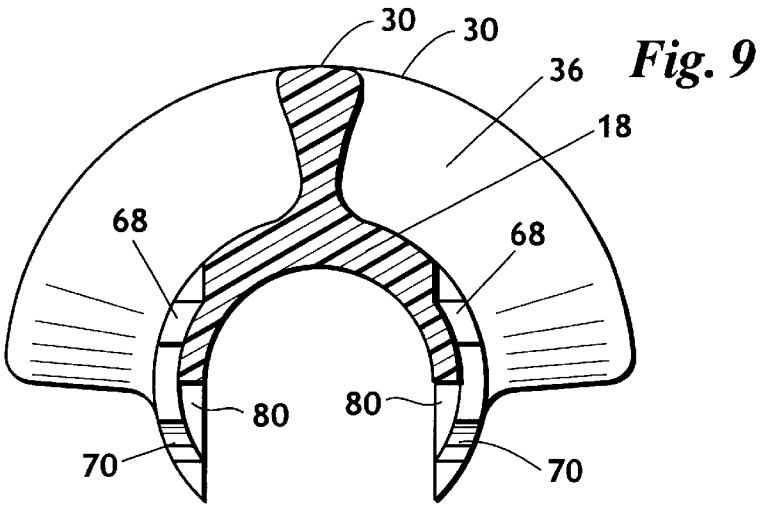
Figure 11:
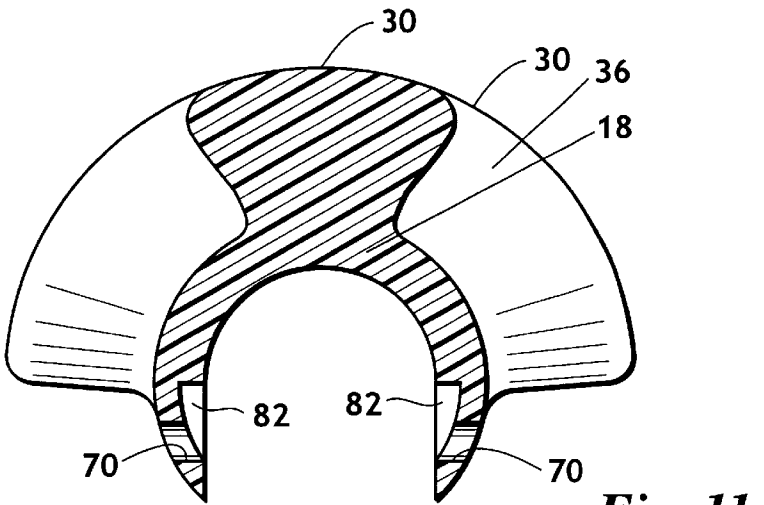
Figure 8:
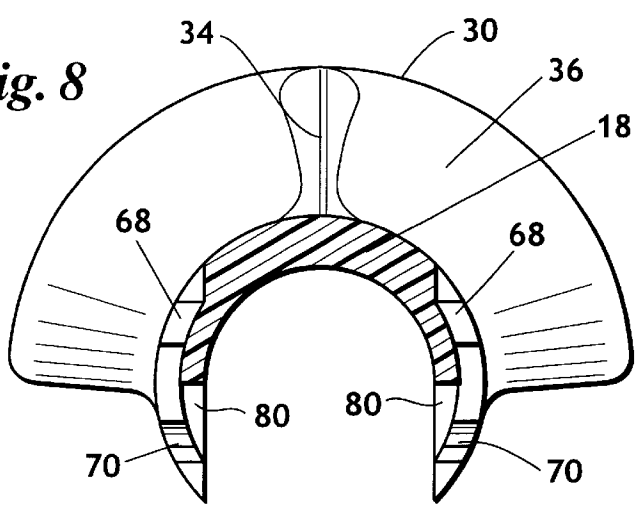
Figure 10:
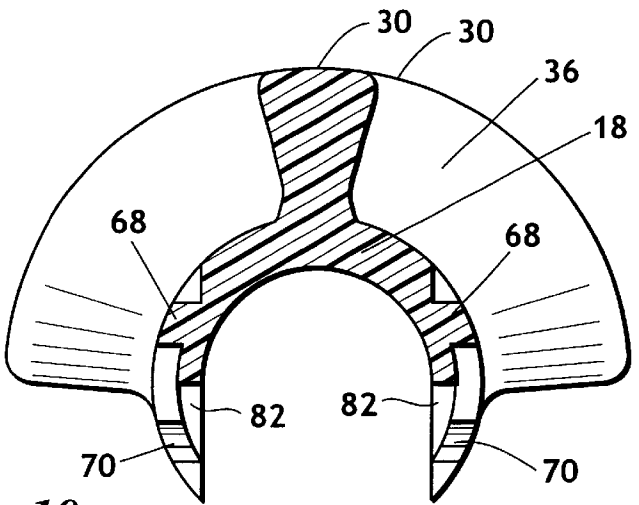
Figure 13:
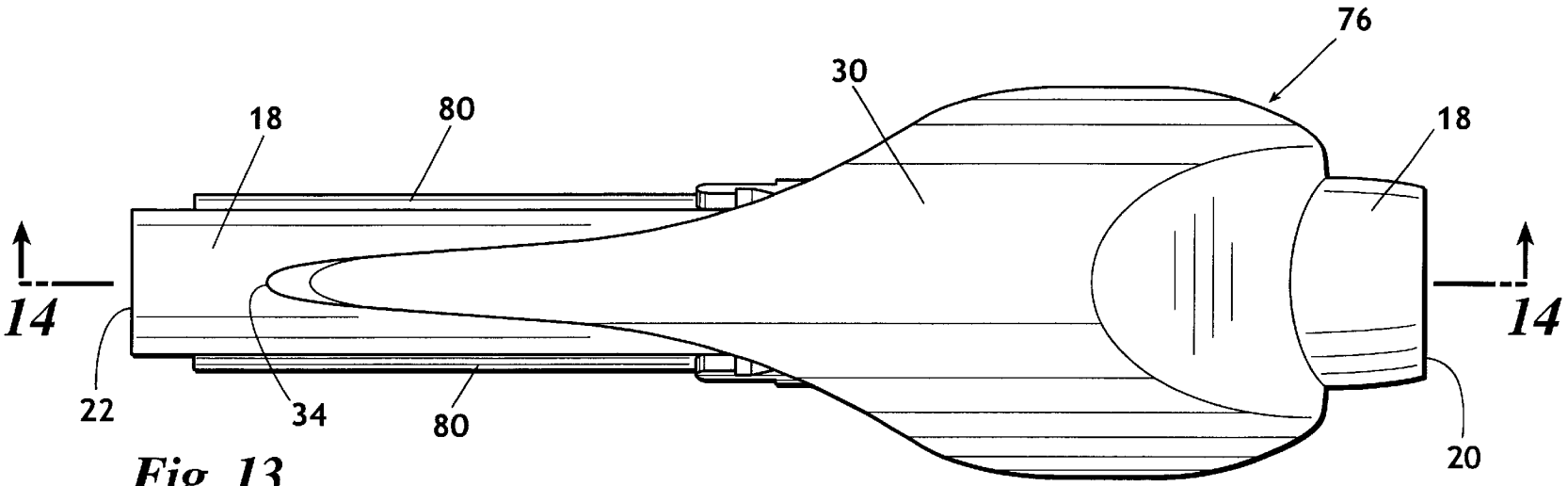
FIG. 13 is a top plan view of the one-half sucker rod guide as taken along the line 13—13 of FIG. 5.
Figure 14:
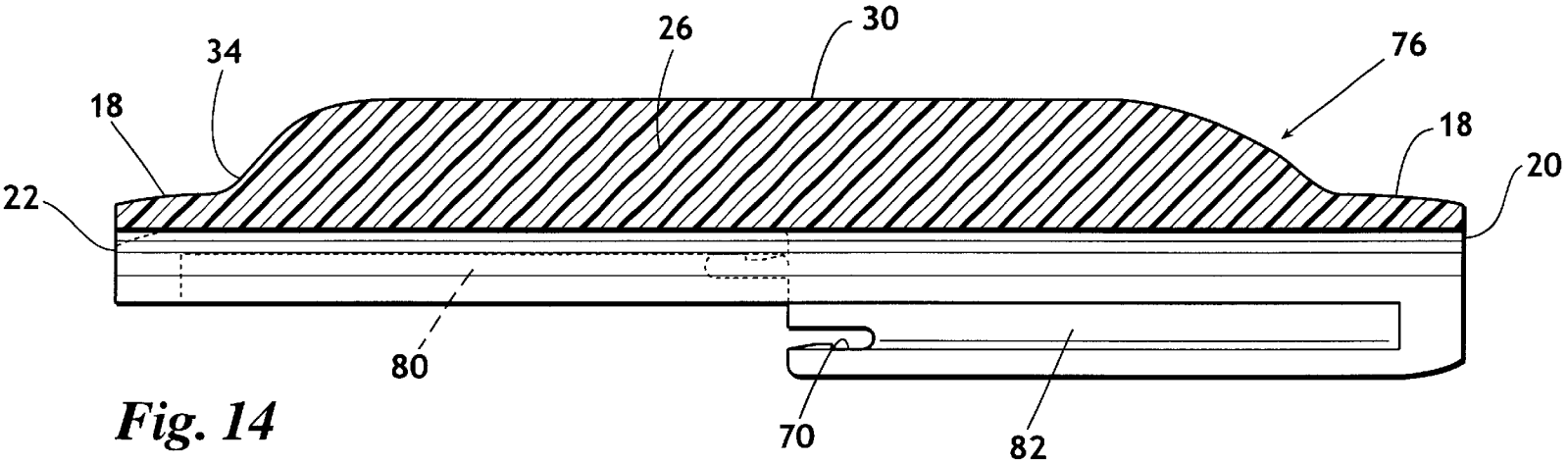
FIG. 14 is a longitudinal cross-sectional view of a one-half sucker rod guide as taken along the line 14—14 of FIG. 13.

FIG. 5 is an elevational side view of one-half of a sucker rod guide that has one-half of the external configuration of the guide as illustrated in FIGS. 2 through 4. The one-half of the sucker rod guide as seen in FIG. 5 has an integral extending tang 68 and, spaced from it, a tang slot 70. FIG. 5 shows one side of the sucker rod guide half and the opposite side (not shown) has the same arrangement. Thus each half of the sucker rod guide has two spaced apart tangs 68 and two tang slots 70. The tangs 68 are provided with a lock surface 72 and each tang slot has a mating lock surface 74. When one-half of a sucker rod guide is slid into position with respect to the other on a sucker rod, the lock surfaces of the tangs and tang slots engage each other to prevent the halves from being separated during pumping action.

Figure 15:
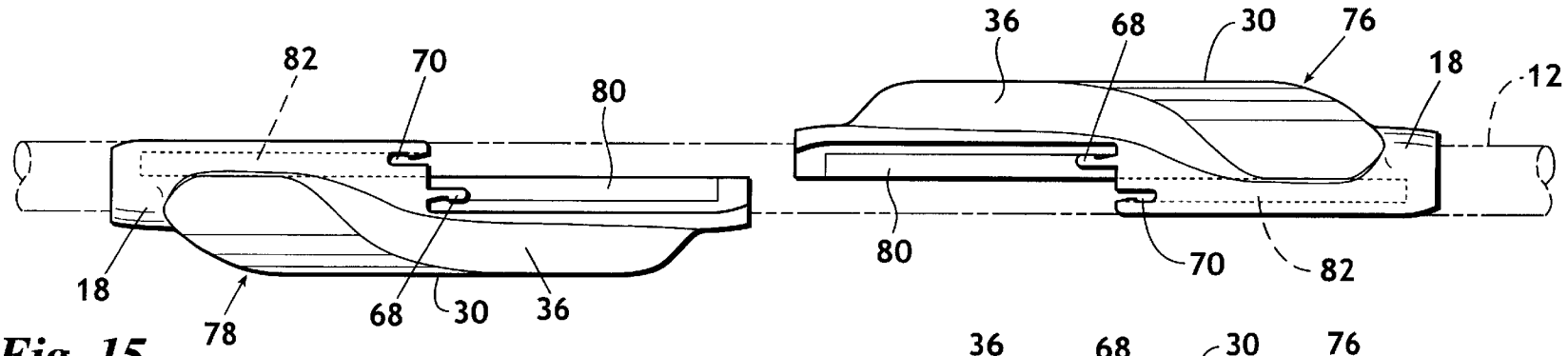
FIGS. 15, 16 and 17 are sequential views.
Figure 16:
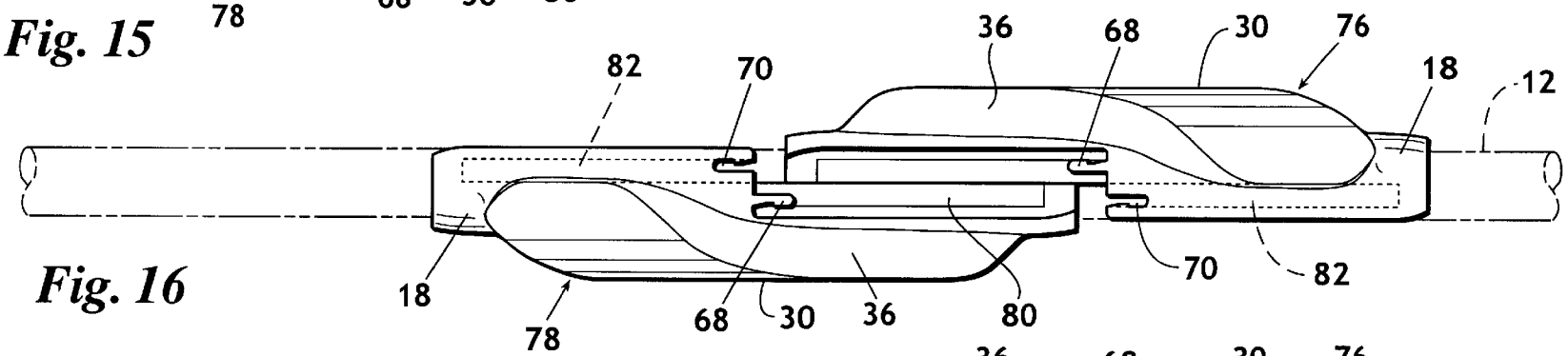
Figure 17:
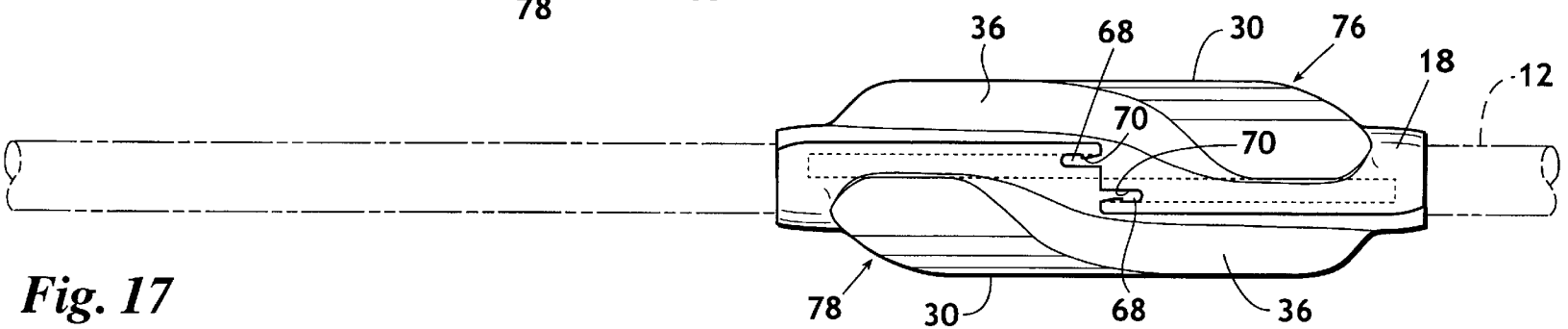

FIGS. 15 and 16 show sucker rod guide halves in the process of being assembled onto a sucker rod. FIG. 15 shows a first sucker rod guide half generally indicated by the numeral 76 on the right hand side and a second sucker rod guide half generally indicated by the numeral 78 on the left hand side and shows both halves in slidable position on the surface of a sucker rod 12. FIG. 16 shows the left half 78 moved toward right half 76. FIG. 17 shows the halves joined to each other in secured relationship upon the surface of sucker rod 12. FIG. 17 shows the assembled halves joined together to provide a sucker rod guide having the external appearance of the guide configuration shown in FIGS. 2 through 4 with the same guide portions and guide surfaces as described with respect to these figures. FIG. 17 shows the tangs 68 lockably received in the tang slots 70 and locked within the tang slots.

Figures 20, 21:
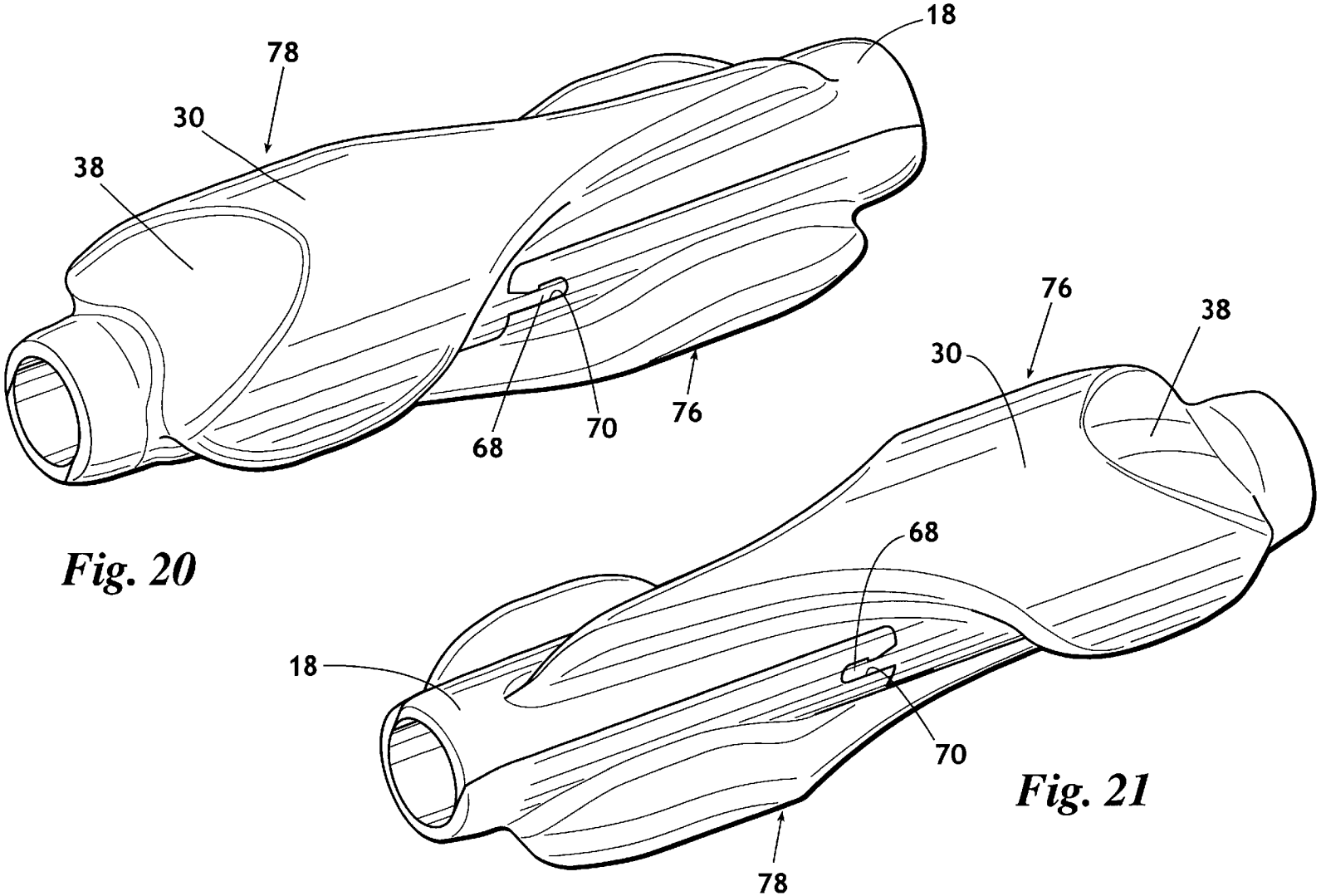
FIG. 20 is an isometric view of a field-installed type of sucker rod guide where the two halves have been locked together and in which the sucker rod, around which they would be locked, is not shown.
FIG. 21 is an isometric view as in FIG. 20 wherein the two halves of the field-installed type sucker rod guide are locked in position, but without the sucker rod, and in which the sucker rod guide is longitudinally reversed with respect to FIG. 20.

The tangs and tang slots with their locking surfaces function to engage the separate halves of a guide to hold it in interlocked relationship after assembled as shown in FIG. 17 as well as in FIGS. 20 and 21. In addition to locking the two halves together it is important that the halves securely lock onto the external surface of the sucker rod 12. For this purpose, each half is provided on its forward end with opposed arc shaped tongues 80 and rearwardly thereof elongated tongue grooves 82. The tongues 80 and grooves 82 are slightly inclined relative to the imaginary longitudinal axis of each of the guide halves 76 and 78 so that as the tongues 80 of each guide half is slid into a tongue groove 82 of the mating guide half, the halves are forced toward each other to thereby securely grasp sucker rod 12 on which they are positioned. Because of the small angle of incline, the angles are not noticeable in the drawings but the slight angular relationship between the tongues and grooves is important for effective functioning of the guides.

Figure 18:
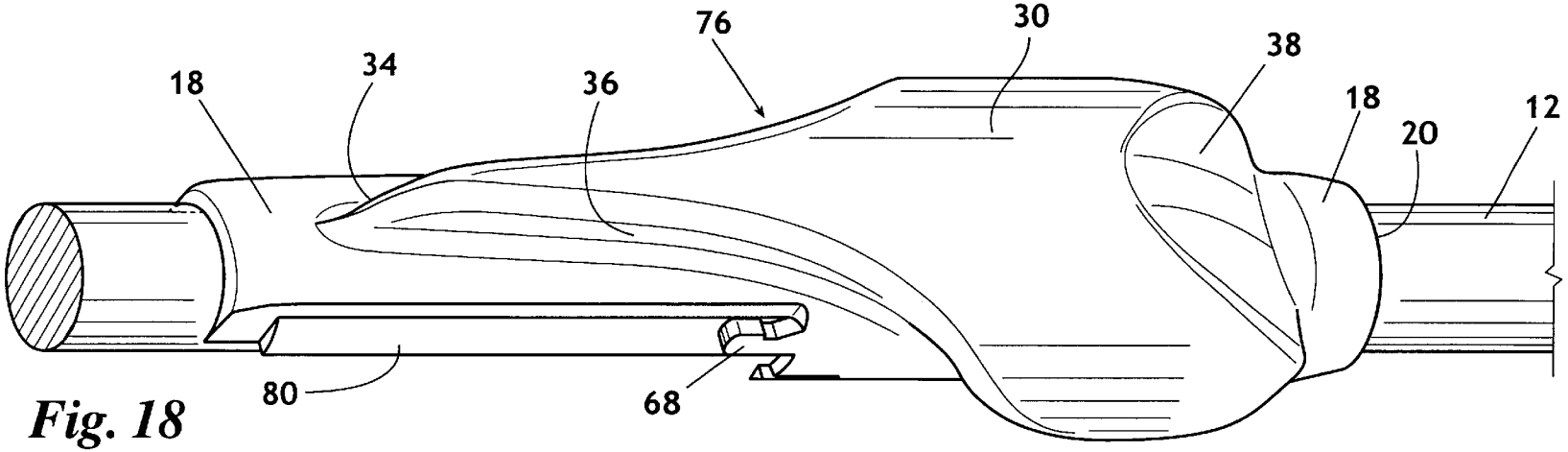
FIG. 18 shows a portion of a length of a sucker rod and in isometric relationship a one-half of the field installed type sucker rod guide in position for attaching it to the sucker rod.
Figure 19:
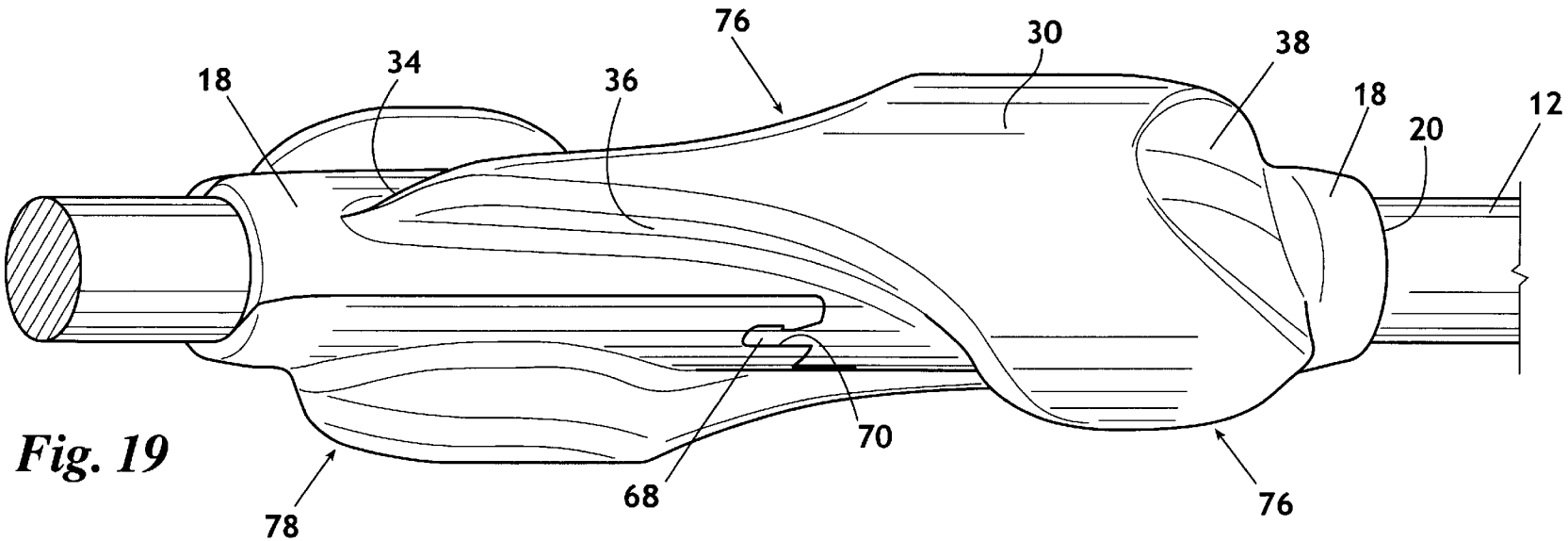
FIG. 19 shows the second half of the field-installed type of sucker rod guide in locked position with respect to the first half.

FIG. 18 illustrates isometrically the elongated integral tongue 80 that is formed on each side of each of the sucker rod guide halves. Each tongue 80 has a semi-cylindrical external surface that matches the mating semi-cylindrical grooves 82 (see FIGS. 6, 7, 8, 9 10 and 11). The encompassed arc of the semi-cylindrical surface of tongues 80 interferes slightly in the direction towards tubular body upper end 20 while the arc of the groove 82 is substantially of the same shape for its length so that thereby the tongues 80 are wedged into grooves 82 when two halves are forced into full engagement and locked together.

While FIGS. 5 through 21 show the guide halves 76 and 78 each having guide portions 26 and guide surfaces 30 that correspond to the basic embodiment of the invention in FIGS. 3 through 4 it is understood that this is by way of example only. The other illustrated embodiments of the invention, specifically the embodiment of FIGS. 22 to 24, 25 to 27, and 28 to 30 each can be manufactured in the form of a slip-on or snap-on sucker rod guide wherein the guides are in two identical halves that slide together as has been described but wherein, after matingly joined on a sucker rod, the resultant guide will have external physical appearances as shown in these FIGS. 23 through 30 except for the line that separates the two halves. The invention herein provides a sucker rod guide and paraffin scraper characterized by guide surfaces that sweep the full 360° internal cylindrical wall of a tubing in which the guide is used and wherein the flow passageways between the guide portions are streamlined for smooth fluid flow. Particularly the flow passageways are configured to encourage laminar, non-turbulent fluid flow and thereby to reduce any drag on the reciprocation of a sucker rod string having the guides of this invention attached to it and to minimize resistance to flow of pumped fluid upwardly through the tubing in which the sucker rod guides are employed. In addition, the guides of this invention provide for large and yet streamlined guide surfaces to thereby insure long, useful life with minimal wear on the interior tubing in which the guides are used.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A guide used on a sucker rod vertically reciprocated within tubing in which the tubing has an internal cylindrical surface of diameter "D" comprising:

an elongated tubular body portion having an upper end and a lower end and having an external, generally cylindrical surface and a concentric central opening therethrough of internal diameter substantially conforming to the external cylindrical surface of the sucker rod and having integral first and second increased thickness guide portions, each guide portion having a contact surface of a generally streamlined teardrop shape, the second guide portion guide surface being elevationally inverted compared to the first guide surface, the guide surfaces each being semi-cylindrical of diameter slightly less than "D" and of maximum circumference of at least about 180° adjacent a first end, the first and second guide portions being rotationally spaced opposite of each other providing laminar first and opposed second separate flow passageways therebetween each extending uninterruptedly between said tubular body upper and lower ends.

2. A guide used on a sucker rod according to claim 1 wherein said first end of each of said generally teardrop shaped integral guide portions is further defined by a generally planar outer surface inclined at an acute angle relative to a central axis of said tubular body portion.

3. A guide for use on a sucker rod according to claim 1 formed of plastic of a type that withstands elevated temperature and severe frictional wear.

4. A guide for use on a sucker rod according to claim 3 formed of polyphenalene sulphide or nylon.

5. A guide for use on a sucker rod according to claim 1 that is molded of plastic material directly onto the sucker rod.

6. A guide for use on a sucker rod according to claim 1 molded as two like halves that can be slideably positioned into interlocked relationship onto the sucker rod.

7. A guide for use on a sucker rod according to claim 6 wherein said two halves are substantially identical.

8. A guide for use on a sucker rod according to claim 6 wherein each half has at least one integral tang member and at least one tang slot, the tang member of each half being telescopically and interlockably received by a said tang slot of a mating half.

9. A guide for use on a sucker rod according to claim 8 wherein each half has an inclined plane whereby as said two halves slide together said incline planes provide a tightening effect to cinch said two halves together around the sucker rod.

10. A guide for use on a sucker rod according to claim 1 wherein each tubing guide portion extends substantially the length of said tubular body with said first end having a said maximum circumference of at least 180° and having at a second end a circumference of a few degrees whereby said second end is substantially pointed.

11. A guide for use on a sucker rod vertically reciprocated within tubing in which the tubing has an internal cylindrical surface of diameter "D" comprising:

an elongated tubular body portion concentrically surrounding the sucker rod; and first and second guide portions integrally extending from said body portion, each guide portion having a semi-cylindrical guide surface of diameter slightly less than "D" and of arc of about 180°, the second guide portion being rotationally diametrically opposed to said first guide portion whereby the opposed guide surfaces together provide about 360° of guide surface adjacent the tubing internal cylindrical surface and wherein said first and second guide portions are displaced with respect to each other providing a pair of separate diametrically opposed laminar fluid flow passageways isolated from each other and each of the separate passageways being of substantially the full length of said tubular body portion; and wherein each guide portion is of streamlined teardrop shaped and extends substantially the full length of said tubular body portion with a first end having said arc of about 180° and a second end having an arc of a few degrees whereby said second end is substantially pointed.

12. A guide for use on a sucker rod according to claim 11 formed of plastic of a type that withstands elevated temperature and severe frictional wear.

13. A guide for use on a sucker rod according to claim 12 formed of polyphenylene sulphide or nylon.

14. A guide for use on a sucker rod according to claim 11 that is molded of plastic material directly onto the sucker rod.

15. A guide for use on a sucker rod according to claim 11 molded as two like halves that can be slideably positioned into interlocked relationship onto the sucker rod.

16. A guide for use on a sucker rod according to claim 15 wherein said two halves are substantially identical.

17. A guide for use on a sucker rod according to claim 15 wherein each half has at least one integral tang member and at least one tang slot, the tang member of each half being telescopically and interlockably received by a said tang slot of a mating half.

18. A guide for use on a sucker rod according to claim 17 wherein each half has an inclined arc whereby as said two halves slide together said incline arc provides a tightening effect to cinch said two halves together around the sucker rod.

19. A guide used on a sucker rod vertically reciprocated within tubing in which the tubing has an internal cylindrical surface of diameter "D" comprising:

an elongated tubular body portion having an upper end and a lower end and having an external generally cylindrical surface and a concentric central opening therethrough of internal diameter substantially conforming to the external cylindrical surface of the sucker rod; and having integral first and second increased thickness guide portions each having a semi-cylindrical guide surface of diameter slightly less than "D" and of about 180° arc, the first guide portion being oriented radially opposite and elevationally inverted with respect to the second guide portion whereby portions of the guide surfaces together are in substantial circumferential contact with portions of the full tubing internal cylindrical surface, said guide portions being rotationally displaced from each other providing first and second laminar flow passageways therebetween that are isolated from each other and each of substantially the full length of said tubular body portion, said semi-cylindrical guide surface of each of said guide portions being of streamlined generally teardrop shape, the shape of said guide surface of said second guide portion being elevationally inverted compared to said first guide portion.

20. A guide for use on a sucker rod according to claim 19 wherein each of said first and second guide portions is substantially semi-cylindrical having an upper end edge and a lower end edge that are each generally in planes perpendicular the sucker rod longitudinal axis, the lower edge of said first guide portion being elevationally above the upper edge of said second guide portion, each guide portion having a generally semi-cylindrical guide surface of diameter slightly less than "D" and of about 180° arc and each guide surface having an upper and a lower generally planar surface inclined at an acute angle relative to said sucker rod longitudinal axis the planar surfaces intersecting said semi-cylindrical guide surface.

* * * * *